United States Patent [19]

Bromley

[11] 4,350,030

[45] Sep. 21, 1982

[54] LUGGAGE CASE RESETTABLE SEQUENTIAL COMBINATION LOCK

[75] Inventor: Robert L. Bromley, Aurora, Colo.

[73] Assignee: Samsonite Corporation, Denver, Colo.

[21] Appl. No.: 201,026

[22] Filed: Oct. 27, 1980

[51] Int. Cl.[3] ..... E05B 37/08

[52] U.S. Cl. ..... 70/70; 70/303 R

[58] Field of Search ..... 70/69, 70, 71, 303 R, 70/303 A, 302, 312, 321, 322

[56] References Cited

U.S. PATENT DOCUMENTS

| | | | |
|---|---|---|---|
| 525,299 | 8/1894 | Ward et al. | 70/303 R |
| 1,146,720 | 7/1915 | Leonard | 70/303 R |
| 1,887,797 | 11/1932 | Borzin | 70/303 R |
| 3,800,571 | 4/1974 | Heine | 70/71 |
| 3,952,561 | 4/1976 | Bake | 70/70 |

*Primary Examiner*—Robert L. Wolfe

[57] ABSTRACT

A combination lock is provided for a luggage case having a single rotary dial sequentially manipulatable to open or release the lock and enable operating the case latching mechanism. A reset arm extends from the combination lock housing within the luggage which can be adjusted to the combination reset mode at which time rotation of the rotary in accordance with some new desired set of combination numbers changes the lock combination accordingly. On returning the reset arm to the operating mode, the lock can only now be opened by the new combination.

6 Claims, 16 Drawing Figures

LUGGAGE CASE RESETTABLE SEQUENTIAL COMBINATION LOCK

The present invention relates to a resettable sequential combination lock primarily adapted for use in a luggage case, and, more particularly, such a combination lock which is of simplified construction, having a minimum number of parts and the lock combination of which can be changed without the use of an auxiliary implement.

SUMMARY OF THE INVENTION

In the practice of the present invention, there is provided a combination lock for incorporation into the wall structure of a luggage case having a single rotary dial which is sequentially manipulatable in accordance with the lock combination to open or release the lock and thereby the luggage case. An actuator element extends from the housing containing the combination lock parts and latch mechanism lock which can be set to a position enabling changing of the lock combination. That is, when it is desired to change the combination of this lock, the actuator is adjusted to the change position and then the dial indicator is merely rotated in a way to be described to set the new desired combination into the lock after which the actuator is then returned to the fixed position after which the lock can only be opened by the new combination.

DESCRIPTION OF THE PREFERRED EMBODIMENT

Figure 1:
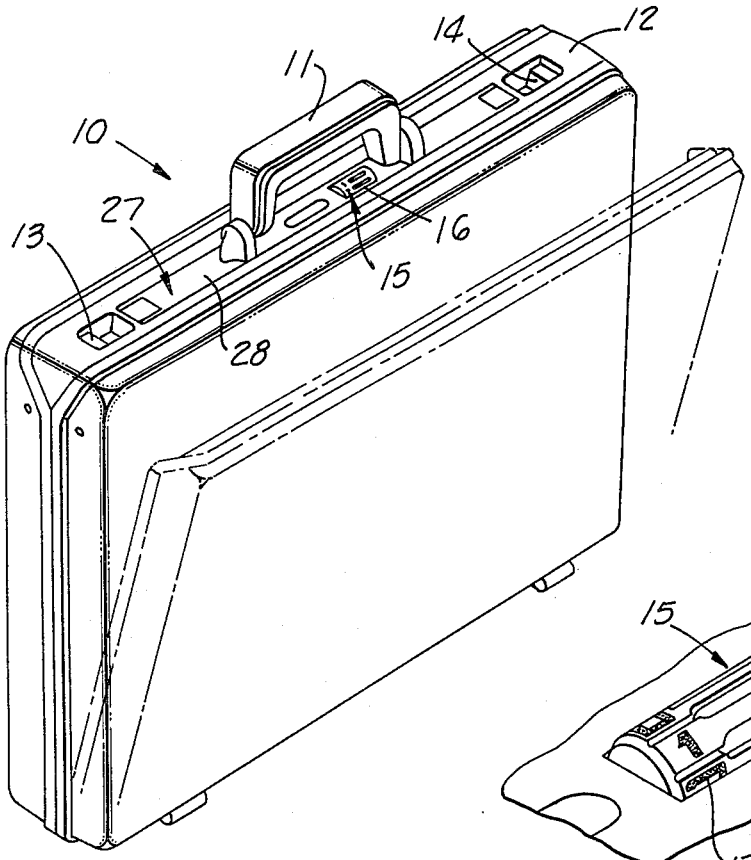
FIG. 1 is a perspective view of a luggage case including the combination lock of this invention.

With reference now to the drawings and particularly FIG. 1, a luggage case enumerated generally as at 10, is depicted with which the resettable combination lock of this invention is especially adapted for use. The luggage case shown in FIG. 1 is a so-called attache case which includes a carrying handle 11 connected to the case top wall 12 within which top wall finger actuators 13 and 14 are provided for opening the latching mechanism. Also located in the top wall immediately underneath the carrying handle is the combination lock 15 of this invention to be described.

Figure 2:
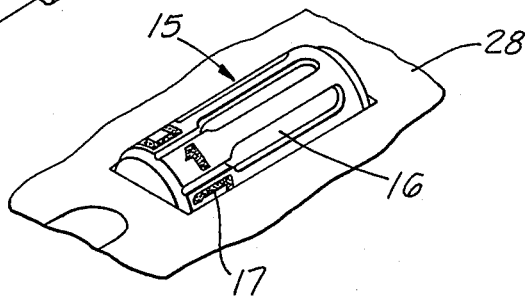
FIG. 2 is a perspective, partially fragmentary view showing the rotary dial of the combination lock.
Figure 16:
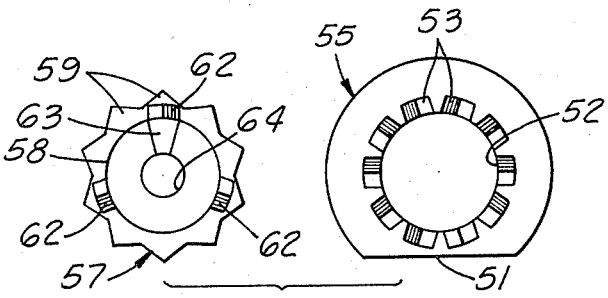
FIG. 16 is an end elevational view of a locking disc and locking hub.

Turning now to FIG. 2, the only part of the combination lock 15 that appears or is exposed on the outside of the attache case top wall 12, is a generally cylindrically-shaped member 16 including a set of sequentially arranged numbers 17 adjacent one end running circumferentially about the member, and a plurality of circumferentially spaced, longitudinally extending indentations on the outer surface permitting ready grasp and manipulation by fingers of the user. The cylindrical member 16 is rotatably mounted within the upper wall of the attache case with only a portion thereof extending outwardly. In use, the cylindrical member is rotated to the various numbers of the combination in the required sequence, after which the actuators 13 and 14 may be manipulated to open the luggage case (the dashed line depiction).

Figure 3:
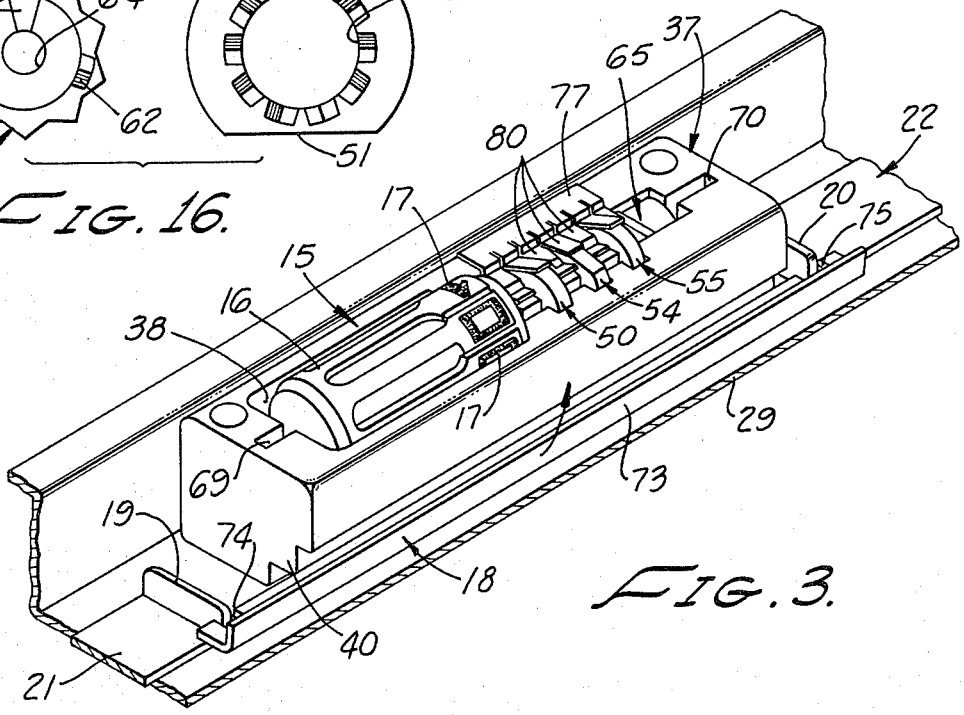
FIG. 3 is a perspective, partially sectional view of the combination lock and adjacent luggage case latching mechanism.

In FIG. 3, the combination lock 15 is shown with the luggage top wall removed. In a way that will be more particularly described, when the lock 15 is locked it locates a hasp plate 18 in its lowermost position such that first and second slots in the hasp plate are received onto upstanding ears 19 and 20 of latch arms 21 and 22, respectively. That is, when locked the latch arms 21 and 22 are held immovable by the hasp plate. When the combination lock is operated to the release or open position the hasp plate 18 moves upwardly (arrow) from the position shown to one free from engagement with ears 19 and 20. The arms 21 and 22, which are individually connected to the finger actuators 13,14, are now free to move and, therefore, do not restrict movement of actuators and the case may be opened.

Figure 5:
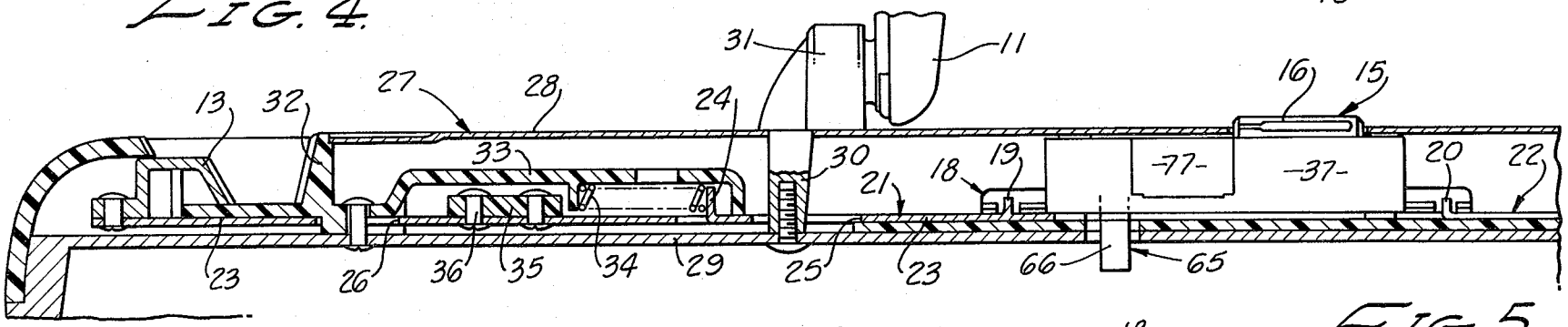
FIG. 5 is a side elevational sectional view taken along the line 5—5 of FIG. 4.

As is shown in greater detail in FIG. 5, the arm 21 (and identical arm 22, as well) includes an elongated platelike member 23 with the upstanding ear 19 at one end and a similar through larger upstanding ear or edge 24 at an intermediate point and the remaining end is interconnected with a finger actuator 13 or 14, as the case may be. A first longitudinally extending elongate opening 25 is formed in the arm member 23 between ears 19 and 24 and second opening 26 is formed therein spaced inwardly of actuators 13 (or 14).

A housing 27 is formed in the top wall of the luggage case by the case outer top wall 28 and an inner wall 29 spaced therefrom. Two downwardly extending spacers 30 from the top wall 28 serve to locate the inner wall 29 at the desired fixed spacing. The spacers are located, respectively, under the connection points 31 for the handle 11 and slidingly extend through the opening 25 of arm 21 or 22, as the case may be.

A molded piece 32 secured to the walls 28 and 29 has parts received through opening 26 in plate 23 and other parts forming a half-shell enclosure 33 within which the ear 24 of member 23 is resiliently held by a spring 34. A hooklike hasp 35 affixed to the plate 23 by rivets 36, for example, extends laterally for latching receipt in the adjacent case section as shown best in FIG. 4.

Figure 4:
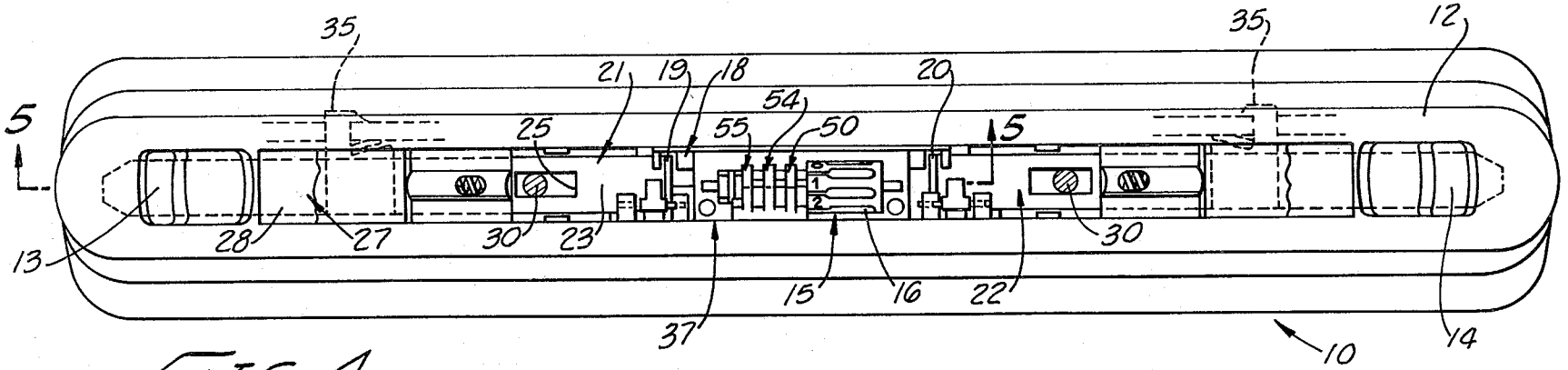
FIG. 4 is a plan partially sectional view of the luggage case with combination lock mounted therein.

Still with reference to FIGS. 4 and 5, when the case is closed the hooklike hasp 35 latches the two case sections together and coil spring 34 presses against ear 24 urging the plate 23 toward the central part of the luggage case top wall (i.e., toward the lock 15). Applying finger pressure against the actuator 13 in a direction toward the adjacent case end wall unlatches the hasp 35 and moves the plate 23 and ears 19,24 toward the same case end wall. On release of the finger pressure on the actuator, the coil spring 34 acts on the ear 24 moving the plate 23 to its maximum inward position with the ears 19 or 20, as the case may be, aligned with slots in the hasp plate 18. As has been alluded to already, when the hasp plate 18 is lowered with the slots in the plate end portions receiving the ears 19 and 20 therein, the luggage case is locked and the actuators 13 and 14 cannot be operated.

Figure 15:
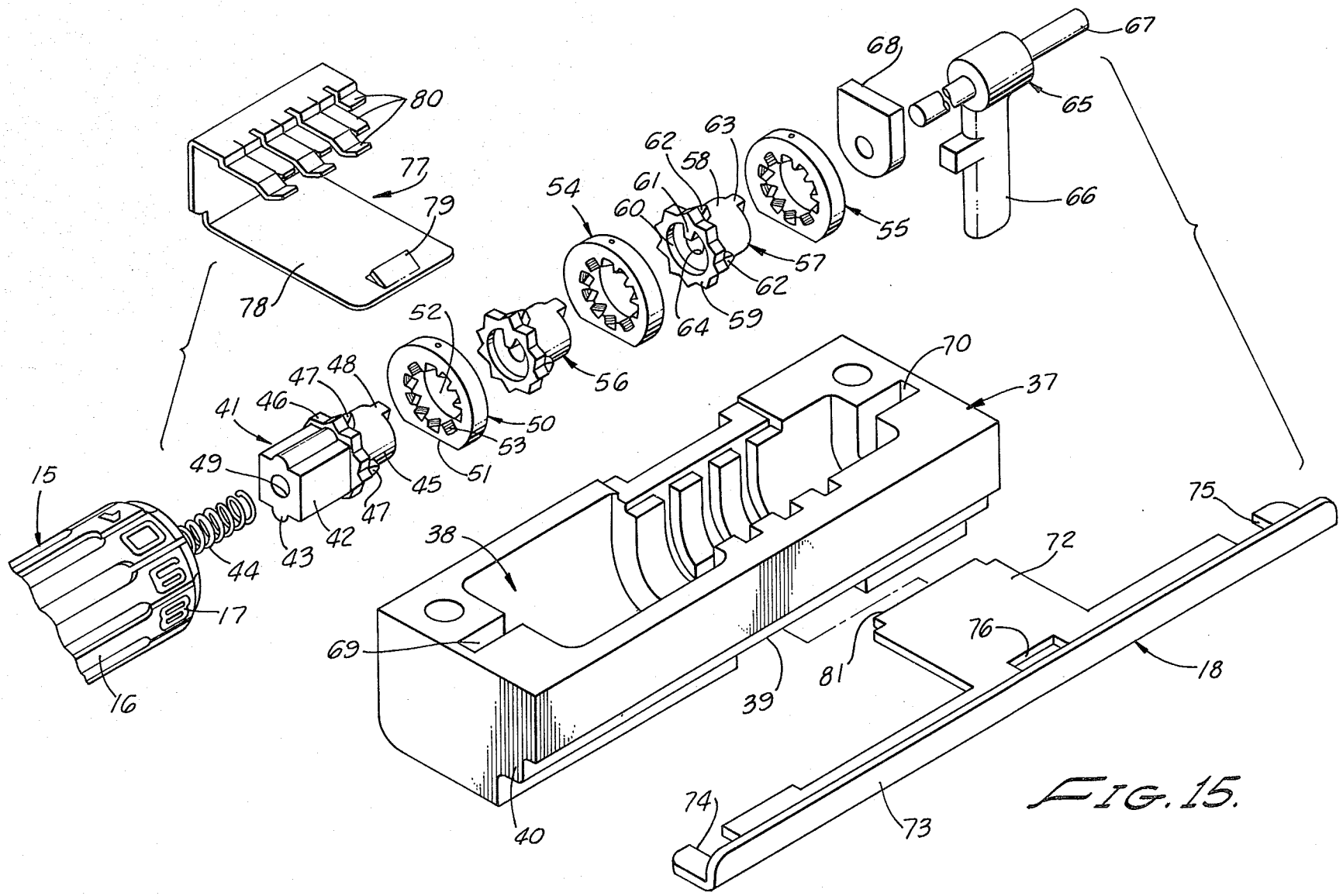
FIG. 15 is an exploded view showing the various parts of the combination lock.

For the ensuing detailed description of the lock construction, reference is now made to FIG. 15 where the lock parts are depicted in exploded relation. The lock housing 37 is preferably of one-piece molded plastic in the general form of a rectangular parallelepiped and including a concavity 38 fully open on one side of the housing and having a centrally located opening 39 on the opposite side of the housing. An outer corner edge is formed into a longitudinally extending recessed step or shoulder 40 for a purpose to be described.

A drive hub 41 has a generally rectangular shank 42 with keying ridges 43 for receipt and proper alignment within a similarly shaped opening (not shown) in the numbered wheel 16 such that rotative motion of the wheel 16 is continuously transmitted to the drive hub. A coil spring 44 is entrapped within the numbered wheel during assembly providing a resilient seating for the drive hub.

Integral with the hub rectangular shaft 42 is an axially extending cylindrical hub 45 with an intervening set of teeth 46 circumferentially arranged about hub 45. Three drive teeth 47 are arranged at 120 degree spacing about the hub 45 extending parallel to the cylindrical axis. A driving protrusion 48 extends from the end face of 45 and is located immediately adjacent the circumferential periphery thereof. An opening 49 extends axially through the drive hub.

A locking disc 50 has its circumferential periphery flattened on one side as at 51 and includes an opening 52 therethrough enabling sliding receipt onto the cylindrical hub 45 of the drive hub 41. A set of recessed teeth 53 are formed in one face of the disc extending along the wall defining the opening 52. The teeth 53 are of such dimensions and geometry as to mesh with the three teeth 47 on the drive hub when the drive hub and disc 50 are assembled together.

There are two further lock discs 54 and 55 which are identical in construction to the disc 50 and, therefore, will not be described in detail here.

The two lock hubs 56 and 57 used in this combination lock are identical and only the details of 57 will be given. A cylindrical hub shaft 58 has an outer diameter such that it may be slidingly received within the opening 52 of a lock disc 50, 54 or 55. A circumferentially extending set of teeth 59 is located at one end of the hub shaft 58 and includes a circular recess 60 in the end face that will receive end of the hub 45 or the hub shaft 58 of lock hub 56, as the case may be, in sliding and rotating relation. A single tooth 61 extends radially into the recess 60 from the peripheral wall thereof. Three teeth 62 are located on the side of the teeth 59 facing generally toward the hub shaft 58 and are mutually arranged at 120 degrees thereabout. As in the case of the teeth 47, the three teeth 62 are so dimensioned as to enable meshing with the internal teeth of the discs 50, 54 and 55. The outer end face of the hub shaft includes a single protrusion 63 located at the peripheral edge and extending radially inwardly a limited amount. An axial opening 64 passes completely through the lock hub.

Figure 6:
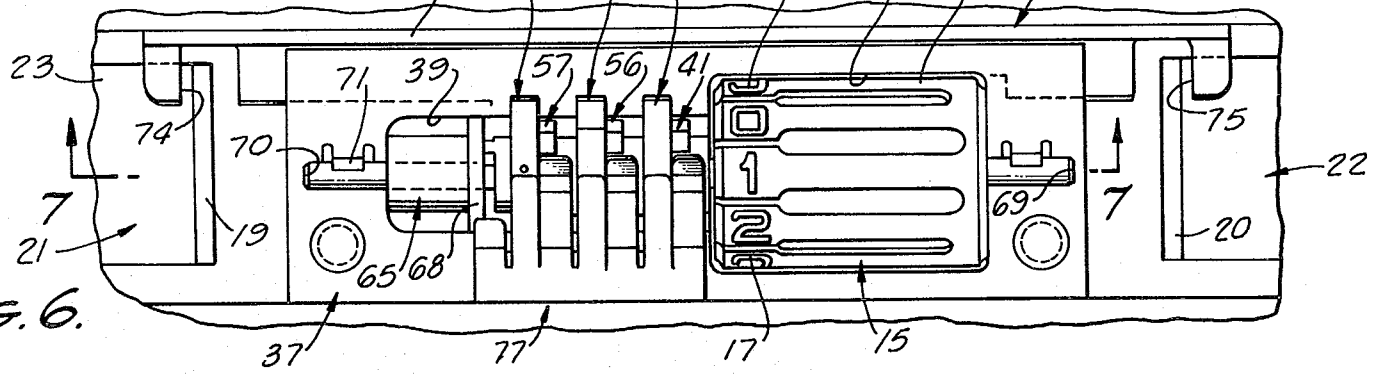
FIG. 6 is an enlarged sectional, partially fragmentary, plan view of the combination lock installed in a luggage case.
Figures 7, 8, 9, 10:
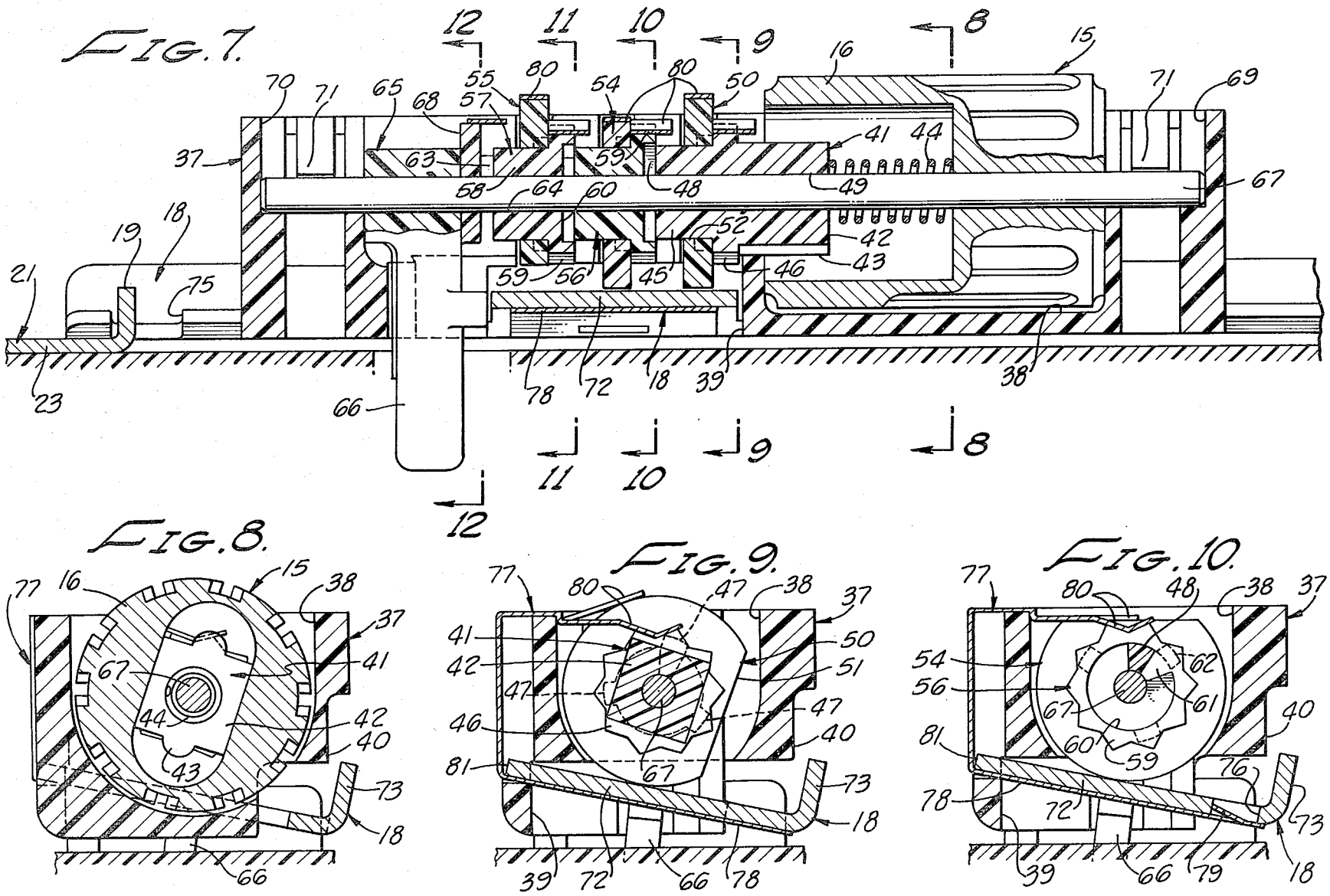
FIG. 7 is a side elevational sectional view taken along the line 7—7 of FIG. 6.
FIGS. 8, 9, 10, 11 and 12 are end elevational sectional views taken along the respective lines 8—8, 9—9, 10—10, 11—11 and 12—12 of FIG. 7.

A reset bar 65 has an adjustment arm 66 slidingly received on a transversely extending shaft 67 which when assembled with the various lock parts passes through the following, in the order named: a bearing plate 68, lock disc 55, lock hub 57, lock disc 54, lock hub 56, lock disc 50, drive hub 41, coil spring 44, and the numbered wheel 16. The opposite ends of shaft 67 are located, respectively, within slots 69 and 70 in housing 37, the various lock parts being located within the cavity 38 and spaced from the housing walls. Resilient springlike members 71 (FIG. 6) snap over the shaft 67 and hold the ends of the shaft, and thus the lock parts, within the slots 69 and 70 in the housing cavity. When so assembled, the peripheral curved portions of the lock discs 50, 54 and 55 extend outwardly of housing 37 through opening 39. However, when the flat side 51 of a disc is positioned within the opening 39, no part of the disc extends outwardly of the housing. The reset bar adjustment arm extends outwardly of the housing 37 through an opening (not shown) on the same side as opening 39.

The hasp plate 18 is generally T-shaped with a center rectangular part 72 which fits into the housing opening 39 at which time the cross-bar 73 is received on the step or shoulder 40. More particularly, the cross-bar includes first and second notches 74 and 75 opening out in the same direction as the center part 72. An opening 76 is formed at the junction of cross-bar 73 and center part 72 for a purpose to be described. The outer longitudinal edge portion of the cross-bar 73 is formed at 90 degrees to the remainder of the cross-bar such that when the hasp plate is assembled onto the housing 37 the cross-bar fits over both sides of the recessed shoulder 40.

A substantially U-shaped spring 77 has a flat side 78 with an ear 79 formed adjacent the outer end and facing inwardly. The opposite spring side includes a plurality of fingers 80 extending upwardly from the spring cross-bar and generally parallel to the sie 78.

When the lock parts are assembled and located within the housing cavity, the hasp plate 18 is placed on the lower side of the housing with the central portion 72 lying over opening 39. The terminus 81 of 72 is anchored in a slot in housing 37 such that the hasp plate is pivotable about the terminus. The spring 77 is then fitted over the housing with the ear 79 being received into the hasp plate opening 76 and the fingers 80 exerting pressure respectively, on the teeth 46 of drive hub 41, teeth 59 of lock hubs 56 and 57, the peripheries of lock discs 50, 54 and 55, and bearing plate 68. By this spring action the rotative motion of the lock parts is in positive increments and the hasp plate is resiliently urged into intimate contacting relation with the housing shoulder 40.

Before proceeding to the detailed lock operation, it is important to note that whenever any one of the locking discs circular edges extends through the opening 39 it (or they) will cam the hasp plate 18 to the position shown in FIG. 3 where the latch arms 21,22 are secured within the notches 74 and 75 preventing opening operation of the latch by manipulation of the finger actuators. That is, this is the locked position which is also depicted in the various sectional views of FIGS. 7 through 12.

On the other hand, when all of lock discs 50, 54 and 55 are positioned with their flattened peripheral portions 51 facing the opening 39, the hasp plate is then pressed aginst the housing 37 by spring 77 which thereby raises the hasp plate away from the latch arms 21,22. This is the unlocked mode and the case may then be opened by manipulation of finger actuators as already described.

For the ensuing description of the combination lock operation, reference is primarily made to FIG. 15 with it being assumed that the lock has been assembled as previously described. The first step in opening the lock is to rotate the numbered wheel 16 in the direction that the numbers occur in their normal order (i.e., 1, 2, 3 . . . ).

After two or more full rotations of the wheel 16, the protrusion 48 on the drive hub 41 will be drivingly engaged with the tooth 61 in lock hub 56, and the protrusion 63 of lock hub 56 will be drivingly engaged with the tooth 61 of drive hub 57. Also, at this time on further turning in the same direction all the lock discs will be driven by meshing of the three teeth 47 with teeth 53, and the sets of three teeth 62 on lock hubs 56 and 57 with the discs 54 and 55.

Having made three (3) or more forward rotations of the numbered wheel 16 the turning is continued until the first number of the combination is reached and then the rotation of the wheel is stopped. Lock disc 55 at this time will have its flattened periphery 51 directly facing the housing opening 39.

For the second number of the combination, the numbered wheel 16 is turned in the backward or reverse direction (i.e., 9, 8, 7 . . . ) for one full revolution during which time the protrusion 48 on the drive hub 41 will move freely within the recess 60 of lock hub 56 and no movement of lock hub 56, disc 54, lock hub 57 and disc 55 will be produced. The reverse rotation is continued on now driving lock hub 56 and disc 54 until disc 54 has its flattened periphery located facing the opening 39 when the second combination number is reached. There has been no change in the disc wheel 55 position since there has been no driving relation between protrusion 63 of hub 56 and the tooth 61 of hub 57.

The third and final number of the combination of manipulated into the lock by turning the numbered wheel 16 once again in the forward direction. When the correct third number is reached, lock disc 50 will have its flattened periphery facing the opening 39. In dialing in the third number nothing beyond lock disc 50 moves, since there is no driving relation between protrusion 48 and the single tooth 61 in drive hub 56.

Figure 14:
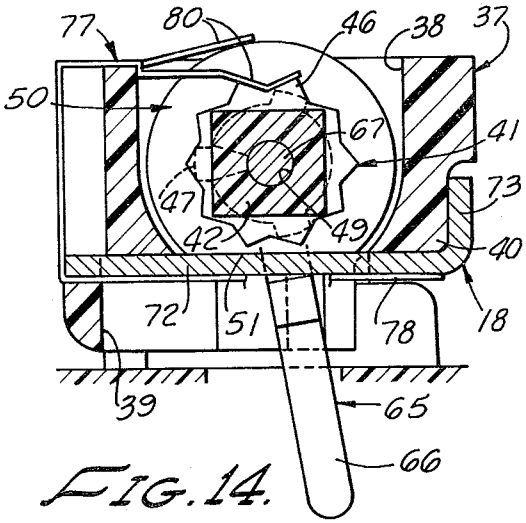
FIG. 14 is an end elevational sectional view taken along the line 14—14 of FIG. 13.
Figure 12:
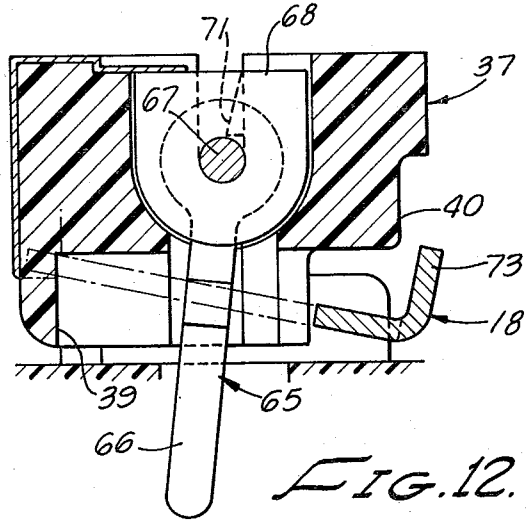
Figure 11:
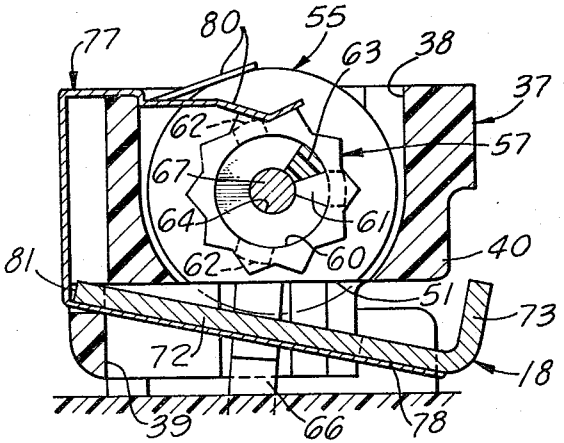
Figure 13:
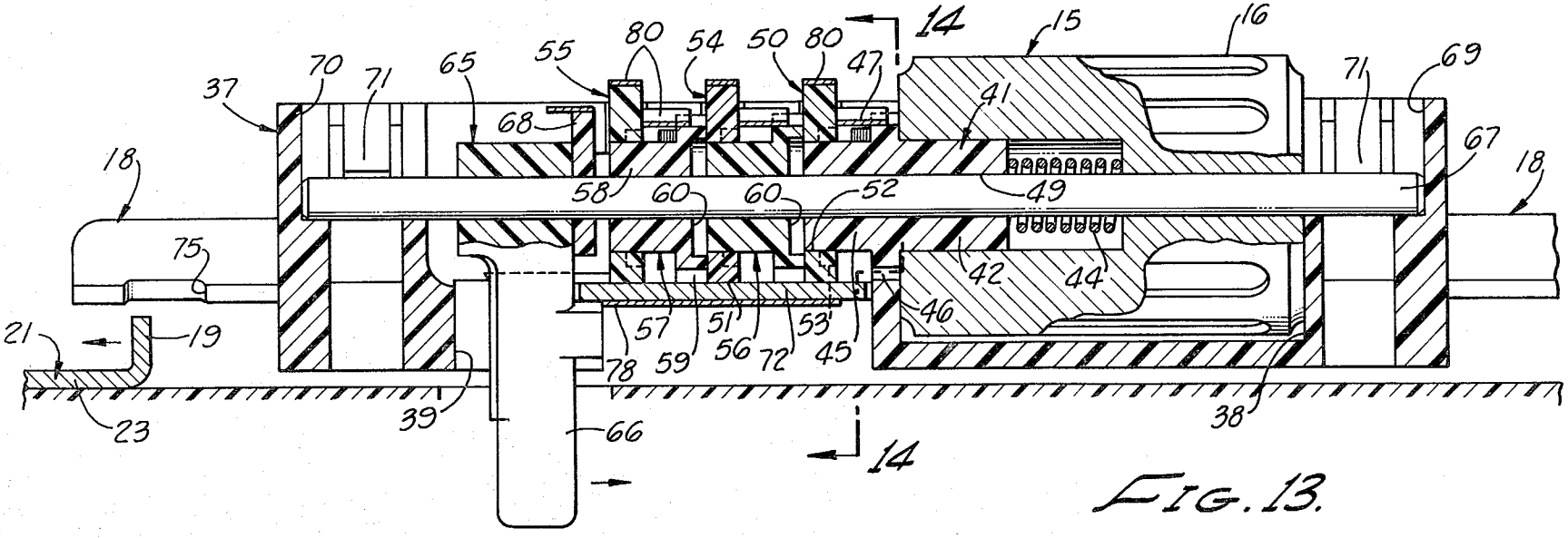
FIG. 13 is a side elevational sectional view similar to FIG. 7 showing the lock unlocked.

To reset the lock to operate on any desired new combination, the first step is to release the lock. When so-released or unlocked, the hasp plate 18 is in the raised position (FIG. 14) which enables the protrusion 82 on the side of the reset bar 65 to move under the hasp plate at which time the reset bar is moved toward the numbered wheel 16. When moved to the point where the reset bar contacts the hasp plate, the bar is rotated about the shaft 67 as an axis into a slot (not shown) in the housing 37 to retain the bar in the reset mode throughout the combination change. When in the rest mode the drive hub 41 and lock hubs 56,57 are disengaged from the lock discs 50, 54 and 55; however, the drive hub and lock hubs remain engaged. Accordingly, adjustment of the numbered wheel will rotate the drive hub and lock hubs but the lock discs will retain their open position (i.e., flattened peripheries facing the hasp plate).

With the reset bar in the reset mode, the numbered wheel 16 is rotated in the forward direction at least three (3) revolutions to insure driving relation of all parts, and then the wheel is stopped at the first number of the new combination. The wheel is then rotated in the reverse direction for one (1) full revolution past the first number and stopped at the second number of the new combination. The wheel is once again rotated in the forward direction and stopped at the third number. The reset bar is moved out of its retaining slot and by the help of the coil spring 44 resumes its normal operational mode with the lock discs engaged with the drive hub and lock hubs. The lock can now only be opened by using the new combination.

I claim:

1. A combination lock, comprising:

a housing including a cavity in one side and first and second openings in another side thereof in communication with said cavity;

a shaft mounted in the housing cavity;

a numbered wheel rotatably mounted on said shaft;

drive hub means rotatably mounted on said shaft and having a first end interconnected with the numbered wheel for rotation therewith, a cylindrical hub extending away from the numbered wheel, tooth means arranged about the cylindrical hub and spaced inwardly from a second end of said hub means, and a protrusion on said second end;

first and second lock hubs each including a generally cylindrical body having an axial opening therethrough, a protrusion on a first end of the cylindrical body, a recess of larger dimensions than the diameter of the cylindrical body formed in second end of said cylindrical body, a set of teeth arranged about the cylindrical body facing the first end and a radially extending tooth located on the wall defining the recess periphery;

first, second, and third discs, each having a central bore, a set of teeth surrounding said bore adapted to mesh with the teeth on said lock hubs and drive hub means, and a flattened peripheral edge portion;

said first disc being located on the shaft and received on the drive hub means cylindrical hub with the first disc teeth meshing with the teeth on said drive hub means, the first lock hub being located on the shaft with its recess receiving the protrusion of said drive hub means therein, the second disc being received on both the shaft and the cylindrical hub of said first lock hub with the second disc teeth meshing with the teeth of said first lock hub, the second lock hub being located on the shaft with its recess receiving the protrusion of the first lock hub therein, and the third disc being received on the shaft and cylindrical hub of the second lock hub with the teeth of each meshing together;

peripheral circular edge portions of the first, second and third discs extending outwardly of the housing through said housing first opening, the flattened peripheral edge portions remaining with the housing at all rotative positions of said discs;

plate means having an edge pivotally related to the housing and extending over the housing first opening; and spring means resiliently holding said plate means on said housing.

2. A combination lock as in claim 1, said spring means is a generally U-shaped leaf spring, one arm of which extends over and contacts an outwardly directed surface of the plate means and the other arm extends over the cavity.

3. A combination lock as in claim 2, in which the spring means other arm is formed into separate finger means which individually contactingly engage the drive hub means, first and second lock hubs, and first, second and third discs providing resilient resistance to rotation of the same about said shaft.

4. A combination lock as in claim 3, in which there is provided a reset arm slidingly received on said shaft outwardly of said third disc and having an end portion thereof extending outwardly of said housing through the housing second opening, said reset arm being movable on said shaft toward said numbered wheel effecting disengagement of said first, second and third discs from the drive hub means and the first and second lock hubs.

5. A combination lock as in claim 3, in which said drive hub means and said first and second lock hubs each include a further set of teeth arranged in a closed circumferential path and the finger means contact said teeth providing positive positioning during rotation thereof.

6. A combination lock as in claim 1, in which said plate means includes a first part extending over the housing first opening and a second part integral with said first part and extending transversely of said first part.

* * * * *